US011837167B2

(12) United States Patent
Kim et al.

(10) Patent No.: US 11,837,167 B2
(45) Date of Patent: Dec. 5, 2023

(54) DISPLAY DEVICE OPTIMIZING POWER CONTROL SIGNAL OF SOURCE DRIVER INTEGRATED CIRCUIT TO OPTIMIZE POWER CONSUMPTION

(71) Applicant: LG Display Co., Ltd., Seoul (KR)

(72) Inventors: MinKi Kim, Daegu (KR); JinSung Kim, Seoul (KR); JinCheol Hong, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/854,776

(22) Filed: Jun. 30, 2022

(65) Prior Publication Data

US 2023/0005425 A1 Jan. 5, 2023

(30) Foreign Application Priority Data

Jun. 30, 2021 (KR) ..... 10-2021-0086039

(51) Int. Cl.

*G09G 3/3233* (2016.01)
*G09G 3/20* (2006.01)
*G09G 3/3283* (2016.01)
*G09G 3/3266* (2016.01)

(52) U.S. Cl.

CPC ..... *G09G 3/3233* (2013.01); *G09G 3/2074* (2013.01); *G09G 3/3283* (2013.01); *G09G 3/3266* (2013.01); *G09G 2300/0452* (2013.01); *G09G 2300/0809* (2013.01); *G09G 2310/027* (2013.01); *G09G 2310/0286* (2013.01); *G09G 2310/0291* (2013.01); *G09G 2310/08* (2013.01); *G09G 2330/021* (2013.01); *G09G 2360/10* (2013.01)

(58) Field of Classification Search

CPC ..... G09G 3/36; G09G 3/3611; G09G 3/3614; G09G 3/3622; G09G 3/3625; G09G 3/364; G09G 3/3674; G09G 3/3677; G09G 3/3681; G09G 3/3685; G09G 3/3688; G09G 3/3692; G09G 3/3696

USPC ..... 345/87–104

See application file for complete search history.

(56) References Cited

U.S. PATENT DOCUMENTS

| | | | | |
|---|---|---|---|---|
| 11,514,848 | B2 * | 11/2022 | Kim | G09G 3/3275 |
| 2003/0179170 | A1 * | 9/2003 | Lee | G09G 3/3648 345/87 |
| 2004/0041802 | A1 * | 3/2004 | Tsutsui | G09G 3/3648 345/211 |
| 2011/0037746 | A1 * | 2/2011 | Kim | G09G 3/3688 345/87 |

(Continued)

*Primary Examiner* — Amit Chatly
*Assistant Examiner* — Nelson Lam
(74) *Attorney, Agent, or Firm* — Birch, Stewart, Kolasch & Birch, LLP

(57) ABSTRACT

A display device can include a display panel having sub pixels configured to emit light of different colors, a data driver configured to output a data voltage to the sub pixels via data lines, and a timing controller configured to output power control signals for controlling a driving current which drives the data driver. The data driver can include source driving integrated circuits, each including power control circuits configured to generate the driving current in accordance with each of the power control signals, and amplifiers configured to be applied with the driving current to output the data voltage to each of the data lines.

17 Claims, 14 Drawing Sheets

(56) References Cited

U.S. PATENT DOCUMENTS

2016/0055803 A1* 2/2016 Kim ..... G09G 3/3233
345/691
2016/0189581 A1* 6/2016 Hwang ..... G09G 3/006
345/691

* cited by examiner

| Threshold (CD) | PWRC (3bit) |
|---|---|
| CD ≤ Th.1 | P0 |
| Th.1< CD ≤ Th.2 | P1 |
| Th.2< CD ≤ Th.3 | P2 |
| Th.3< CD ≤ Th.4 | P3 |
| Th.4< CD ≤ Th.5 | P4 |
| Th.5< CD ≤ Th.6 | P5 |
| Th.6< CD ≤ Th.7 | P6 |
| Th.7 < CD | P7 |

| | Image I | Image II | Image III |
|---|---|---|---|
| Comparative Example | 35.41 | 59.77 | 80.81 |
| Embodiment Example | 28.16 | 34.41 | 39.47 |

DISPLAY DEVICE OPTIMIZING POWER CONTROL SIGNAL OF SOURCE DRIVER INTEGRATED CIRCUIT TO OPTIMIZE POWER CONSUMPTION

CROSS-REFERENCE TO RELATED APPLICATIONS

This application claims the priority to Korean Patent Application No. 10-2021-0086039 filed on Jun. 30, 2021, in the Korean Intellectual Property Office, the entire contents of which are hereby expressly incorporated by reference into the present application.

BACKGROUND OF THE DISCLOSURE

Field

The present disclosure relates to a display device, and more particularly, to a display device which is capable of controlling a driving current.

Background

Among the display devices being used as a monitor of a computer, a television, or a cellular phone, there are an organic light emitting display device (OLED) which is a self-emitting device, and a liquid crystal display device (LCD) which requires a separate light source.

Among various display devices, an organic light emitting display device includes a display panel having a plurality of sub pixels and a driver which drives the display panel. The driver includes a gate driver configured to supply a gate voltage to the display panel and a data driver configured to supply a data voltage. When a gate voltage and a data voltage are supplied to a sub pixel of the organic light emitting display device, the sub pixel emits light with a luminance corresponding to a driving current to display images.

The data driver includes a plurality of source driving integrated circuits (SDIC) and each of the plurality of source driving integrated circuits (SDIC) supplies the data voltage to an active area via a plurality of data lines.

Further, the plurality of source driving integrated circuits (SDIC) can control the driving current in accordance with a power control signal PWRC. However, all the source driving integrated circuits SDIC connected to one data driver are applied with the same power control signal PWRC.

The power control signal PWRC can be determined by a load (panel load) of the display panel and a worst power consumption pattern so that the power control signal PWRC may be excessively set.

Accordingly, a driving current may be excessively output to each of the plurality of source driving integrated circuits SDIC so that there can be a limitation in that the power consumption of the organic light emitting display device may be unnecessarily increased.

SUMMARY OF THE DISCLOSURE

An object to be achieved by the present disclosure is to provide a display device which optimizes a power control signal PWRC for each source driving integrated circuit SDIC to optimize the power consumption.

Another object to be achieved by the present disclosure is to provide a display device which controls a power control signal PWRC so as to optimize a driving current according to a color.

Still another object to be achieved by the present disclosure is to provide a display device which controls a power control signal PWRC so as to optimize a driving current for every channel.

Objects of the present disclosure are not limited to the above-mentioned objects, and other objects, which are not mentioned above, can be clearly understood by those skilled in the art from the following descriptions.

In order to achieve the above-described object, according to an aspect of the present disclosure, a display device includes a display panel including a plurality of sub pixels configured to emit light having different colors, a data driver configured to output a data voltage to the plurality of sub pixels via a plurality of data lines, and a timing controller configured to output a plurality of power control signals for controlling a driving current which drives the data driver, the data driver can include a plurality of source driving integrated circuits connected to the plurality of data lines to output the data voltage to the plurality of data lines.

Each of the plurality of source driving integrated circuits can include a plurality of power control circuits configured to generate the driving current in accordance with each of the plurality of power control signals, and a plurality of amplifiers configured to be applied with the driving current to output the data voltage to each of the plurality of data lines. Further, among the plurality of amplifiers, one or more amplifiers connected to any one of the plurality of first data lines, the plurality of second data lines, the plurality of third data lines, and the plurality of fourth data lines can be connected to a same one of the plurality of power control circuits to be applied with the same power control signal.

According to another aspect of the present disclosure, a display device includes a display panel having a plurality of pixels, a data driver configured to output a data voltage to the plurality of pixels via a plurality of data lines, and a timing controller configured to output a plurality of power control signals for controlling a driving current which drives the data driver. The data driver can include a plurality of source driving integrated circuits connected to the plurality of data lines to output the data voltage to the plurality of data lines. Further, each of the plurality of source driving integrated circuits can include a power control signal distributor configured to output each of the plurality of power control signals to each of a plurality of selectors, a plurality of selectors configured to select one of the plurality of driving currents according to each of the plurality of power control signals, and a plurality of amplifiers configured to be applied with the driving current from each of the plurality of selectors to output the data voltage to each of the plurality of data lines.

According to another aspect of the present disclosure, a display device comprises a display panel including a plurality of pixels, a data driver configured to output a data voltage to the plurality of pixels via a plurality of data lines, and a timing controller configured to output a plurality of power control signals for controlling a driving current which drives the data driver. The data driver can include a plurality of source driving integrated circuits connected to the plurality of data lines to output the data voltage to the plurality of data lines. Further, each of the plurality of source driving integrated circuits can include a power control signal distributor configured to output each of the plurality of power control signals to each of a plurality of selectors, the plurality of selectors configured to select one of a plurality of driving currents according to each of the plurality of power control signals, and a plurality of amplifiers configured to be applied with a driving current from each of the plurality of selectors to output the data voltage to each of the plurality of data lines.

According to another aspect of the present disclosure, a display device comprises a display panel including a plurality of sub pixels configured to emit light having different colors, a data driver configured to output a data voltage to the plurality of sub pixels via a plurality of data lines, and a timing controller configured to output a plurality of power control signals for controlling a driving current which drives the data driver. The data driver can include a plurality of power control circuits configured to generate the driving current in accordance with each of the plurality of power control signals, and a plurality of amplifiers configured to be applied with the driving current to output the data voltage to each of the plurality of data lines. Further, among the plurality of amplifiers, one or more amplifiers connected to a plurality of data lines which is connected to a plurality of sub pixels emitting light having same color can be connected to a same power control circuits to be applied with the same power control signal.

Other matters of the exemplary embodiments are included in the detailed description and the drawings.

According to one or more embodiments of the present disclosure, a power control signal is supplied for every color to drive the source driving integrated circuit so that the power consumption can be effectively reduced in an image with a high data transition.

According to one or more embodiments of the present disclosure, the driving current is individually set in accordance with a transition level of a data voltage applied to the plurality of data lines to more finely optimize the driving current of the source driving integrated circuit.

According to one or more embodiments of the present disclosure, the power consumption can be reduced to ensure the driving stability by the improved desired lifespan and the minimized heat generation.

The effects according to the present disclosure are not limited to the contents exemplified above, and more various effects are included in the present specification.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENTS

Figure 1:
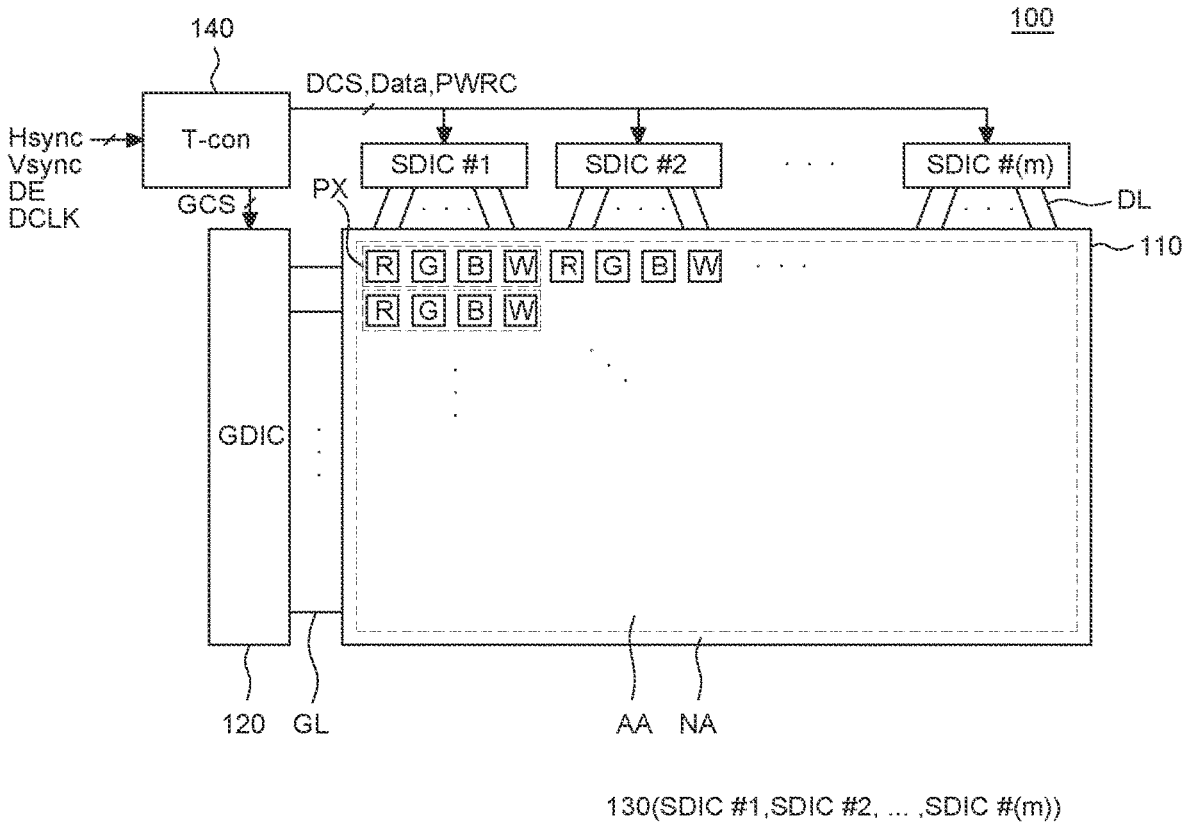
FIG. 1 is a schematic view of a display device according to an exemplary embodiment of the present disclosure.

Advantages and characteristics of the present disclosure and a method of achieving the advantages and characteristics will be clear by referring to exemplary embodiments described below in detail together with the accompanying drawings. However, the present disclosure is not limited to the exemplary embodiments disclosed herein but will be implemented in various forms. The exemplary embodiments are provided by way of example only so that those skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the specification. Further, in the following description of the present disclosure, a detailed explanation of known related technologies can be omitted to avoid unnecessarily obscuring the subject matter of the present disclosure. The terms such as "including," "having," and "consist of" used herein are generally intended to allow other components to be added unless the terms are used with the term "only". Any references to singular can include plural unless expressly stated otherwise.

Components are interpreted to include an ordinary error range even if not expressly stated.

When the position relation between two parts is described using the terms such as "on", "above", "below", and "next", one or more parts can be positioned between the two parts unless the terms are used with the term "immediately" or "directly".

When an element or layer is disposed "on" another element or layer, another layer or another element can be interposed directly on the other element or therebetween.

Although the terms "first", "second", and the like are used for describing various components, these components are not confined by these terms. These terms are merely used for distinguishing one component from the other components and may not define order. Therefore, a first component to be mentioned below can be a second component in a technical concept of the present disclosure.

Like reference numerals generally denote like elements throughout the specification.

A size and a thickness of each component illustrated in the drawing are illustrated for convenience of description, and the present disclosure is not limited to the size and the thickness of the component illustrated.

The features of various embodiments of the present disclosure can be partially or entirely adhered to or combined with each other and can be interlocked and operated in technically various ways, and the embodiments can be carried out independently of or in association with each other. All the components of each display device according to all embodiments of the present disclosure are operatively coupled and configured.

FIG. 1 is a schematic view of a display device according to an exemplary embodiment of the present disclosure.

Referring to FIG. 1, a display device 100 includes a display panel 110, a gate driver 120, a data driver 130, and a timing controller 140.

The display panel 110 is a panel for displaying images. The display panel 110 can include various circuits, wiring lines, and light emitting diodes disposed on the substrate. The display panel 110 is divided by a plurality of data lines DL and a plurality of gate lines GL intersecting each other and can include a plurality of pixels PX connected to the plurality of data lines DL and the plurality of gate lines GL.

The display panel 110 can include a plurality of active areas AA defined by a plurality of pixels PX and a non-active area NA in which various signal lines or pads are formed.

Each of the plurality of pixels PX can include a plurality of sub pixels. The plurality of sub pixels can be sub pixels which emit different color light. For example, the plurality of sub pixels SP can be a red sub pixel R, a green sub pixel G, a blue sub pixel B, and a white sub pixel W, but is not limited thereto. The plurality of sub pixels can configure one pixel PX. For example, the red sub pixel R, the green sub pixel G, the blue sub pixel B, and the white sub pixel W can configure one pixel PX. In other words, the display panel 110 can include a plurality of red sub pixels R, a plurality of green sub pixels G, a plurality of blue sub pixels B, and a plurality of white sub pixels W.

Further, the plurality of red sub pixels R disposed in one column is connected to one red data line to be applied with a red data voltage. Further, the plurality of green sub pixels G disposed in one column is connected to one green data line to be applied with a green data voltage. The plurality of blue sub pixels B disposed in one column is connected to one blue data line to be applied with a blue data voltage. The plurality of white sub pixels W disposed in one column is connected to one white data line to be applied with a white data voltage.

For the convenience of description, the red sub pixel R can be referred to as a first sub pixel, the green sub pixel G can be referred to as a second sub pixel, the blue sub pixel B can be referred to as a third sub pixel, and the white sub pixel W can be referred to as a fourth sub pixel. Further, the red data line can be referred to as a first data line, the green data line can be referred to as a second data line, the blue data line can be referred to as a third data line, and the white data line can be referred to as a fourth data line.

However, even though it is described that the display device according to the exemplary embodiment of the present disclosure is configured by the red sub pixel R, the green sub pixel G, the blue sub pixel B, and the white sub pixel W, the present disclosure is not limited thereto. Therefore, the display device can include only the red sub pixel R, the green sub pixel G, and the blue sub pixel B excluding the white sub pixel W. Accordingly, in the display panel of the display device according to the exemplary embodiment of the present disclosure, only the red data line, the green data line, and the blue data line excluding the white data line can be disposed.

In the meantime, the display panel 110 can be implemented by a display panel 110 used in various display devices such as a liquid crystal display device, an organic light emitting display device, or an electrophoretic display device.

The timing controller 140 can receive a timing signal such as a vertical synchronization signal Vsync, a horizontal synchronization signal Hsync, a data enable signal DE, and a data clock signal DCLK via a receiving circuit connected to a host system, such as an LVDS or a TMDS interface. The timing controller 140 generates control signals DCS or GCS for controlling the data driver 130 and the gate driver 120 based on the input timing signal.

For example, in order to control the gate driver 120, the timing controller 140 outputs various gate control signals GCS including a gate start pulse, a gate shift clock, and a gate output enable signal.

Here, the gate start pulse controls an operation start timing of the gate driver 120. The gate shift clock is a clock signal which is commonly input to one or more gate circuits and controls a shift timing of the gate voltage. The gate output enable signal designates output timing information of the gate driver 120.

Further, in order to control the data driver 130, the timing controller 140 outputs various data control signals DCS including a source start pulse, a source sampling clock, and a source output enable signal.

Here, the source start pulse controls a data sampling start timing of one or more source driving integrated circuits SDIC which configure the data driver 130. The source sampling clock is a clock signal which controls a sampling timing of data in each data circuit. The source output enable signal controls an output timing of the data driver 130.

Further, the timing controller 140 transmits digital video data Data to the data driver 130. The digital video data Data is converted into an analog data voltage in the data driver 130 to be output to each pixel PX disposed in the active area AA.

Further, the timing controller 140 outputs a power control signal PWRC to the data driver 130. The driving current of one or more source driving integrated circuits SDIC which configure the data driver 130 can be controlled by the power control signal PWRC.

In the meantime, the timing controller 140 is an embedded clock point to point interface (EPI) which transmits/receives data in the form of a voltage of a differential swing level and transmits a data control signal DCS, video data Data, and a power control signal PWRC to the data driver 130.

The gate driver 120 supplies the gate voltage to the plurality of pixels PX. The gate driver 120 can be configured by a plurality of stages which shifts and outputs the gate voltage in response to the gate control signal GSC. The plurality of stages included in the gate driver 120 can sequentially output the gate voltage to the plurality of pixels PX via the gate lines GL. The gate driver 120 can be a gate driving integrated circuit GDIC which is formed in the non-active area NA of the display panel 110 by a gate in panel (GIP) manner, but is not limited thereto.

The data driver 130 supplies the data voltage to the plurality of pixels PX. The data driver 130 can include a plurality of source driving integrated circuits (SDIC). For example, as illustrated in FIG. 1, the data driver 130 can include a first source driving integrated circuit SDIC #1, a second source driving integrated circuit SDIC #2, . . . , and an m-th source driving integrated circuit SDIC #m. Here, m is a natural number of 1 or larger.

The plurality of source driving integrated circuits SDIC #1, SDIC #2, . . . , and SDIC #m can be supplied with digital video data Data, a data control signal DCS, and a power control signal PWRC from the timing controller 140. Each of the plurality of source driving integrated circuits SDIC #1, SDIC #2, . . . , and SDIC #m generates a data voltage from the digital video data Data using an analog gamma voltage in response to the data control signal DCS. Further, each of the plurality of source driving integrated circuits SDIC #1, SDIC #2, . . . , and SDIC #m can output the data voltage to the plurality of pixels PX by a driving current determined by the power control signal PWRC, via the data line DL.

The plurality of source driving integrated circuits SDIC #1, SDIC #2, . . . , and SDIC #m can be connected to the data line DL of the display panel 110 by a chip on glass (COG) process or a tape automated bonding (TAB) process. Further, the plurality of source driving integrated circuits SDIC #1, SDIC #2, . . . , and SDIC #m is formed on the display panel 110 or can be formed on a separate PCB substrate to be connected to the display panel 110.

Figure 2:
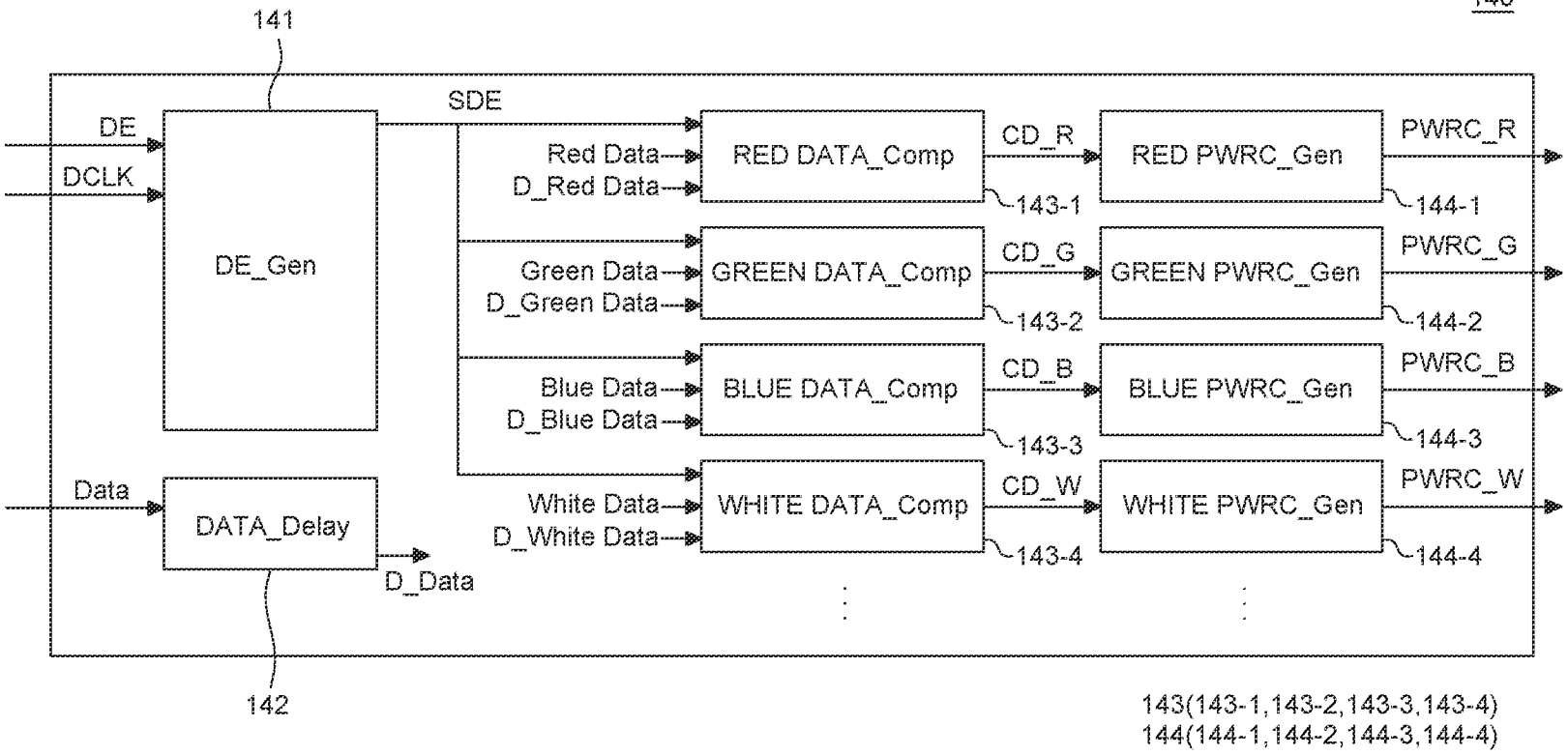
FIG. 2 is a view for explaining a timing controller of a display device according to an exemplary embodiment of the present disclosure.

FIG. 2 is a view for explaining a timing controller of a display device according to an exemplary embodiment of the present disclosure.

Referring to FIG. 2, the timing controller 140 includes a data enable signal generators 141, a data delaying unit 142, a plurality of data comparators 143 (RED DATA Comp, GREEN DATA Comp, BLUE DATA Comp and WHITE DATA Comp), and a plurality of power control signal generators 144 (RED PWRC Gen, GREEN PWRC Gen, BLUE PWRC Gen and WHITE PWRC Gen).

The data enable signal generator 141 is synchronized with a data enable signal DE and a data clock signal DCLK to output a sub data enable signal SDE to each of the plurality of data comparators 143.

Specifically, the sub data enable signal SDE is a signal which determines a timing that each of the first source driving integrated circuit SDIC #1 to the m-th source driving integrated circuit SDIC #m outputs a data voltage to the active area AA.

For example, since a data voltage is applied to one pixel row during one horizontal period, the sub data enable signal SDE can be output at a high level which is a turn-on level, during one horizontal period.

The data delaying unit 142 is applied with a video data Data to delay the video data by one horizontal period and then output the delayed video data.

The data delaying unit 142 stores the video data Data in an internal memory and delays the video data by one horizontal period, and then outputs the delayed video data D_Data to each of the plurality of the data comparators 143.

For example, the data delaying unit 142 stores video data Data corresponding to an n−1-th row in an n−1-th horizontal period and then outputs delayed video data D_Data corresponding to the n−1-th row in an n-th horizontal period.

Specifically, the video data Data includes red data Red Data, green data Green Data, blue data Blue Data, and white data White Data so that the delayed video data D_Data can be data obtained by delaying the data. For example, the delayed video data D_Data includes delayed red data D Red Data, delayed green data D Green Data, delayed blue data D Blue Data, and delayed white data D White Data.

Figures 3, 4:
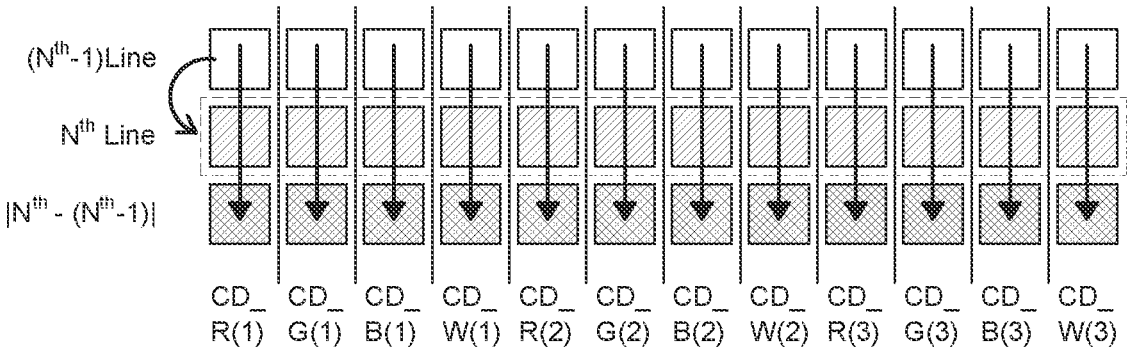
FIG. 3 is a view for explaining an operation of a data comparator of a display device according to an exemplary embodiment of the present disclosure.
FIG. 4 is a view illustrating a look-up table (LUT) of a power control signal generator of a display device according to an exemplary embodiment of the present disclosure.

FIG. 3 is a view for explaining an operation of a data comparator of a display device according to an exemplary embodiment of the present disclosure.

Further, each of the plurality of data comparators 143 compares the video data Data and the delayed video data D_Data while the plurality of sub data enable signals SDE is at a turn-on level to generate a plurality of comparison data CD. Further, each of the plurality of data comparators 143 outputs the comparison data CD to the power control signal generator 144. In other words, the above-described comparison data CD can refer to a maximum data transition value of adjacent pixel rows (N−1-th line and N-th line) in each of the plurality of active areas AA.

To be more specific, referring to FIG. 3, the first data comparator 143-1 compares the red data Red Data of the present pixel row (N-th line) and delayed red data D Red Data of the previous pixel row ((N−1)-th line) while the sub data enable signal SDE is at a turn-on level to output the plurality of red comparison data CD_R(1), CD_R(2), and CD_R(3) to the first power control signal generator 144-1.

The second data comparator 143-2 compares the green data Green Data of the present pixel row (N-th line) and delayed green data D_Green Data of the previous pixel row ((N−1)-th line) while the sub data enable signal SDE is at a turn-on level to output the plurality of green comparison data CD_G(1), CD_G(2), and CD_G(3) to the second power control signal generator 144-2.

The third data comparator 143-3 compares the blue data Blue Data of the present pixel row (N-th line) and delayed blue data D Blue Data of the previous pixel row ((N−1)-th line) while the sub data enable signal SDE is at a turn-on level to output the plurality of blue comparison data CD_B (1), CD_B(2), and CD_B(3) to the third power control signal generator 144-3.

The fourth data comparator 143-4 compares the white data White Data of the present pixel row (N-th line) and delayed white data D White Data of the previous pixel row ((N−1)-th line) while the sub data enable signal SDE is at a turn-on level to output the plurality of white comparison data CD_W(1), CD_W(2), and CD_W(3) to the fourth power control signal generator 144-4.

For the convenience of description, the red comparison data CD_R can be referred to as first comparison data, the green comparison data CD_G can be referred to as second comparison data, the blue comparison data CD_B can be referred to as third comparison data, and the white comparison data CD_W can be referred to as fourth comparison data.

FIG. 4 is a view illustrating a look-up table (LUT) of a power control signal generator of a display device according to an exemplary embodiment of the present disclosure.

The power control signal generator 144 generates a power control signal PWRC using a plurality of comparison data CD.

Specifically, each power control signal generator 144 applies a maximum value among the plurality of applied comparison data CD to the look-up table LUT to set the power control signal PWRC.

Referring to FIGS. 2 to 4, the first power control signal generator 144-1 compares a maximum value among the plurality of red comparison data CD_R(1), CD_R(2), and CD_R(3) with a plurality of thresholds stored in the LUT to generate a red power control signal PWRC_R. Further, the second power control signal generator 144-2 compares a maximum value among the plurality of green comparison data CD_G(1), CD_G(2), and CD_G(3) with a plurality of thresholds stored in the LUT to generate a green power control signal PWRC_G. Further, the third power control signal generator 144-3 compares a maximum value among the plurality of blue comparison data CD_B(1), CD_B(2), and CD_B(3) with a plurality of thresholds stored in the LUT to generate a blue power control signal PWRC_B. The fourth power control signal generator 144-4 compares a maximum value among the plurality of white comparison data CD_W(1), CD_W(2), and CD_W(3) with a plurality of thresholds stored in the LUT to generate a white power control signal PWRC_W.

For the convenience of description, the red power control signal PWRC_R is referred to as a first power control signal, the green power control signal PWRC_G is referred to as a second power control signal, the blue power control signal PWRC_B is referred to as a third power control signal, and the white power control signal PWRC_W is referred to as a fourth power control signal.

For example, when the comparison data CD is equal to or lower than a first threshold value Th1, the power control signal PWRC is set to P0 (LLL) and when the comparison data CD exceeds the first threshold value Th1 and is equal to or lower than a second threshold value Th2, the power control signal PWRC is set to P1 (LLH). When the comparison data CD exceeds the second threshold value Th2 and is equal to or lower than a third threshold value Th3, the power control signal PWRC is set to P2 (LHL) and when the comparison data CD exceeds the third threshold value Th3 and is equal to or lower than a fourth threshold value Th4, the power control signal PWRC is set to P3 (LHH). When the comparison data CD exceeds the fourth threshold value Th4 and is equal to or lower than a fifth threshold value Th5, the power control signal PWRC is set to P4 (HLL) and when the comparison data CD exceeds the fifth threshold value Th5 and is equal to or lower than a sixth threshold value Th6, the power control signal PWRC is set to P5 (HLH). When the comparison data CD exceeds the sixth threshold value Th6 and is equal to or lower than a seventh threshold value Th7, the power control signal PWRC is set to P6 (HHL) and when the comparison data CD exceeds the seventh threshold value Th7, the power control signal PWRC is set to P7 (HHH).

The first threshold value Th1 to seventh threshold value Th7 are stored in a memory of the power control signal generator 144 and can vary depending on the setting.

Figure 5:
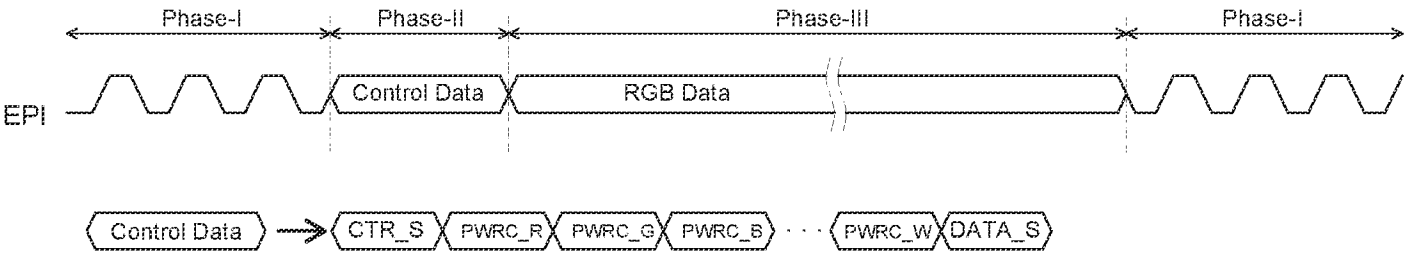
FIG. 5 is a view for explaining a data packet for EPI interface transmission of a timing controller of a display device according to an exemplary embodiment of the present disclosure.

FIG. 5 is a view for explaining a data packet for EPI interface transmission of a timing controller of a display device according to an exemplary embodiment of the present disclosure.

In the meantime, the timing controller 140 is an embedded clock point to point interface (EPI) which transmits/receives data in the form of a voltage of a differential swing level and transmits a data control signal DCS, video data Data, and a power control signal PWRC to the data driver 130.

Specifically, as illustrated in FIG. 5, the data packet for EPI interface transmission can be configured by a first phase Phase-I, a second phase Phase-II, and a third phase Phase-III.

The first phase Phase-I can include a clock signal such as a data clock signal DCLK, the second phase Phase-II can include the data control signal DCS and the power control signal PWRC, and the third phase Phase-III can include video data Data.

In the display device according to the exemplary embodiment of the present disclosure, not all the plurality of comparison data CD is converted into the power control signal PWRC, but the maximum value of the plurality of comparison data CD with the same color is converted into the power control signal PWRC. Therefore, the data size of the power control signal PWRC is not large so that it can be included in the second phase Phase-II. For example, the power control signal PWRC can be transmitted to a previous phase Phase of the video data Data.

Figure 6:
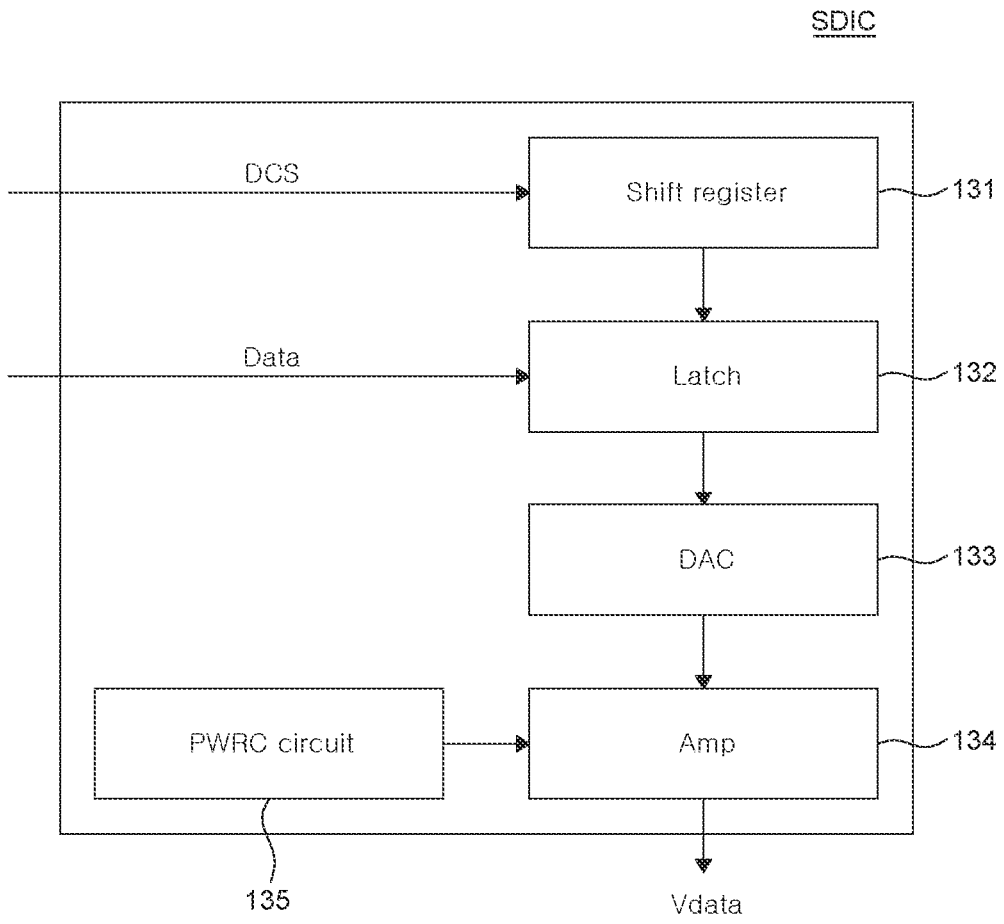
FIG. 6 is a block diagram for schematically explaining a source driving integrated circuit of a display device according to an exemplary embodiment of the present disclosure.

FIG. 6 is a block diagram for schematically explaining a source driving integrated circuit of a display device according to an exemplary embodiment of the present disclosure.

Referring to FIG. 6, each of the plurality of source driving integrated circuits SDIC includes a shift register 131, a latch 132, a digital-analog converter (DAC) 133, an amplifier 134, and a power control circuit 135.

The shift register 131 receives a data control signal DCS including a source start pulse and a source sampling clock from the timing controller 140 to determine a sequential data sampling timing.

The latch 132 sequentially latches red, green, blue, and white digital video data Data transmitted from the timing controller 140 in response to a sampling signal transmitted from the shift register 131 to simultaneously output the red, green, blue, and white digital video data.

The digital-analog converter 133 converts the red, green, blue, and white digital video data Data from the latch 132 into the analog data voltage Vdata using an analog gamma voltage.

The amplifier 134 can output the analog data voltage Vdata transmitted from the digital-analog converter 133 to the data line.

The power control circuit (PWRC circuit) 135 is switched in accordance with the power control signal PWRC transmitted from the timing controller 140 to control an amount of current applied to the amplifier 134, thereby controlling the power consumption of the data driver.

Generally, the power control circuit 135 can be embedded in each of the plurality of source driving integrated circuits SDIC, but the present disclosure is not limited thereto. Therefore, the power control circuit 135 can be disposed in various positions such as a printed circuit board at the outside of the plurality of source driving integrated circuits SDIC or chip on film (COF).

Figure 7:
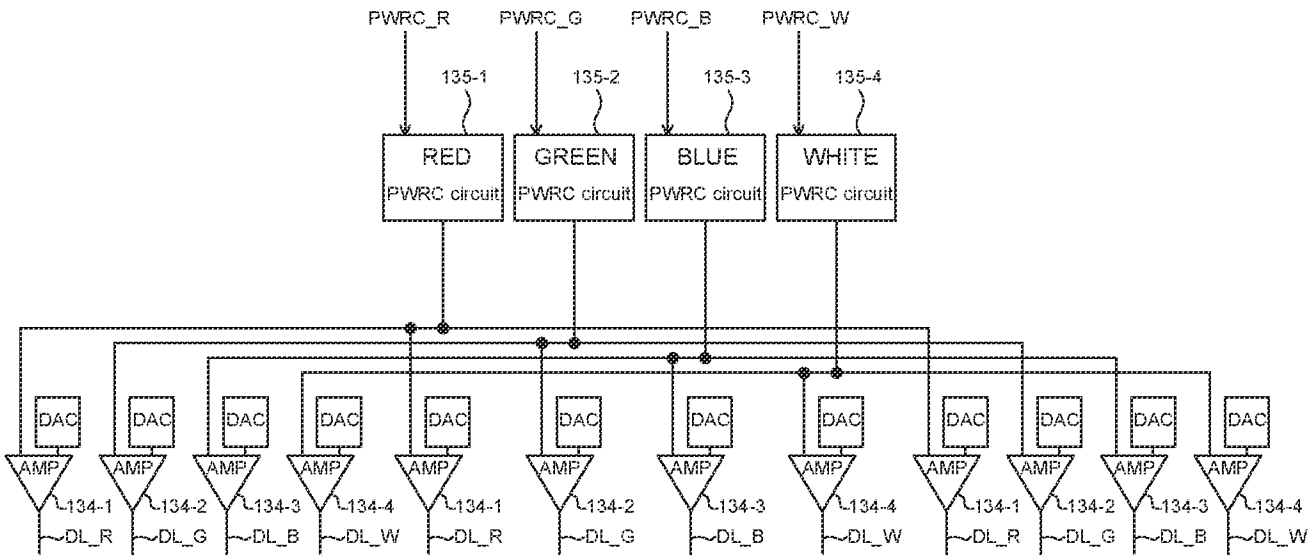
FIG. 7 is a block diagram for explaining a connection relationship of a power control circuit and an amplifier of a display device according to an exemplary embodiment of the present disclosure.

FIG. 7 is a block diagram for explaining a connection relationship of a power control circuit and an amplifier of a display device according to an exemplary embodiment of the present disclosure.

The amplifier 134 can include a first amplifier 134-1 connected to a first data line DL_R, a second amplifier 134-2 connected to a second data line DL_G, a third amplifier 134-3 connected to a third data line DL_B, and a fourth amplifier 134-4 connected to a fourth data line DL_W.

For example, referring to FIG. 7, three first amplifiers 134-1 are connected to three first data lines DL_R so that each of the plurality of the first amplifier 134-1 outputs the red data voltage to each first data line DL_R. Further, three second amplifiers 134-2 are connected to three second data lines DL_G so that each of the plurality of the second amplifier 134-2 outputs the green data voltage to each second data line DL_G. Further, three third amplifiers 134-3 are connected to three third data lines DL_B so that each of the plurality of the third amplifier 134-3 outputs the blue data voltage to each third data line DL_B. Further, three fourth amplifiers 134-4 are connected to three fourth data lines DL_W so that each of the plurality of the fourth amplifier 134-4 outputs the white data voltage to each fourth data line DL_W.

Further, the power control circuit 135 includes a first power control circuit 135-1 (RED PWRC circuit) configured to output a driving current in accordance with the first power control signal PWRC_R, a second power control circuit 135-2 (GREEN PWRC circuit) configured to output a driving current in accordance with the second power control signal PWRC_G, a third power control circuit 135-3 (BLUE PWRC circuit) configured to output a driving current in accordance with the third power control signal PWRC_B, and a fourth power control circuit 135-4 (WHITE PWRC circuit) configured to output a driving current in accordance with the fourth power control signal PWRC_W.

Further, all the plurality of first amplifiers 134-1 is connected to one first power control circuit 135-1. Therefore, all the plurality of first amplifiers 134-1 can be applied with the same first power control signal PWRC_R from one first power control circuit 135-1. Further, all the plurality of second amplifiers 134-2 is connected to one second power control circuit 135-2. Therefore, all the plurality of second amplifiers 134-2 can be applied with the same second power control signal PWRC_G from one second power control circuit 135-2. Further, all the plurality of third amplifiers 134-3 is connected to one third power control circuit 135-3. Therefore, all the plurality of third amplifiers 134-3 can be applied with the same third power control signal PWRC_B from one third power control circuit 135-3. All the plurality of fourth amplifiers 134-4 is connected to one fourth power control circuit 135-4. Therefore, all the plurality of fourth amplifiers 134-4 can be applied with the same fourth power control signal PWRC_W from one fourth power control circuit 135-4.

For example, in one driving integrated circuit of the display device according to the exemplary embodiment of the present disclosure, all the plurality of amplifiers configured to output the data voltage having the same color, among the plurality of amplifiers, can be connected to one power control circuit to be applied with the same power control signal.

Figure 8:
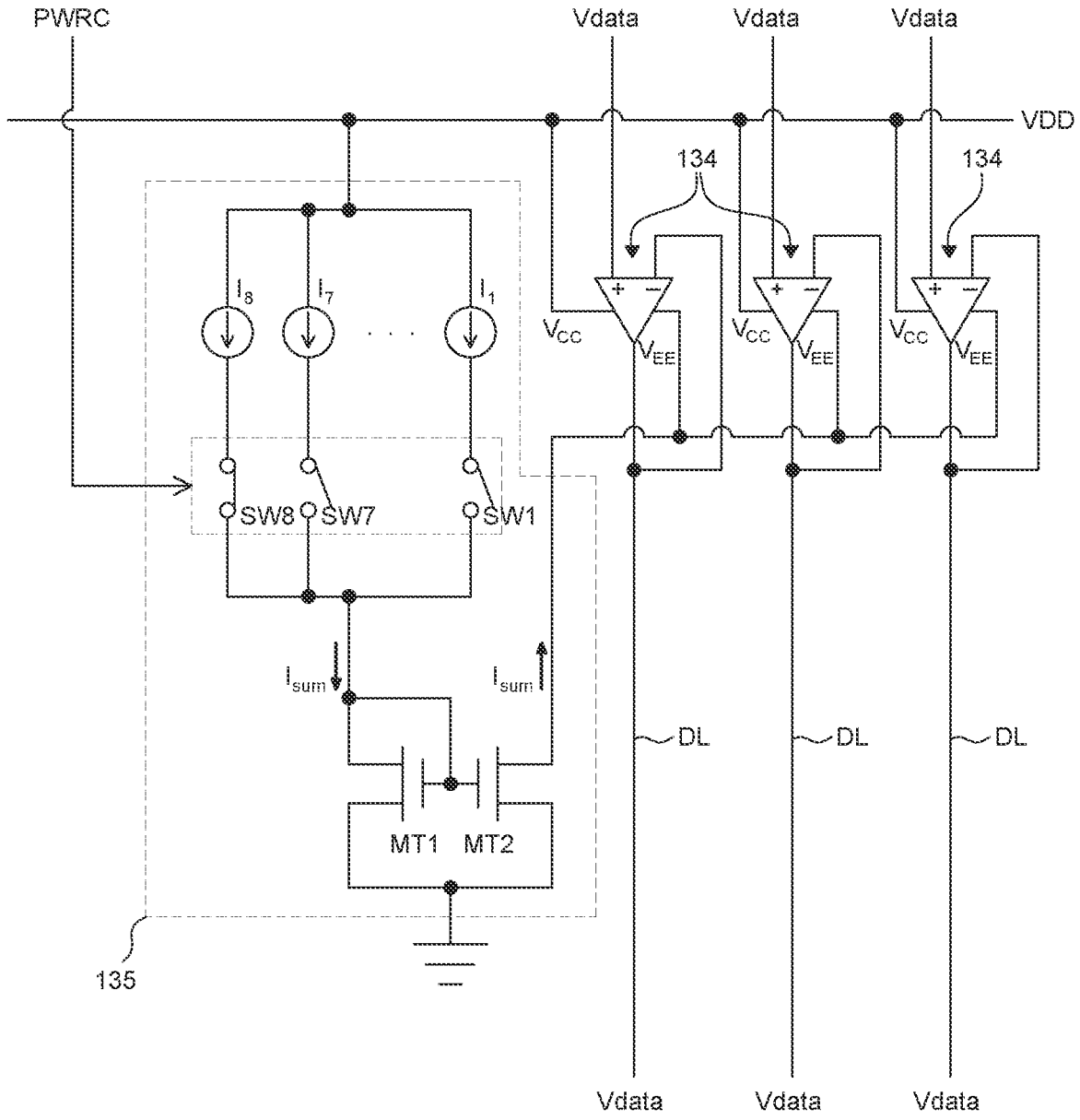
FIG. 8 is a circuit diagram for explaining a power control circuit and a plurality of amplifiers of a display device according to an exemplary embodiment of the present disclosure.

FIG. 8 is a circuit diagram for explaining a power control circuit and a plurality of amplifiers of a display device according to an exemplary embodiment of the present disclosure.

Specifically, FIG. 8 illustrates a plurality of amplifiers 134 which is connected to one of a plurality of power control circuits 135.

Referring to FIG. 8, each of the plurality of amplifiers 134 can be configured by at least one operating amplifier and can be disposed so as to correspond to each of the plurality of data lines DL.

The plurality of data lines DL can be any one of the plurality of first data lines DL_R, the plurality of second data lines DL_G, the plurality of third data lines DL_B, and the plurality of fourth data lines DL_W as described in FIG. 7.

Each of the plurality of amplifiers 134 amplifies and outputs an analog data voltage Vdata received through a non-inverting input terminal (+). The inverting input terminal (−) of each of the plurality of amplifiers 134 is connected to a data line DL connected to an output terminal and a Vcc terminal of each of the plurality of amplifiers 134 is connected to a driver supply voltage VDD, and a terminal $V_{EE}$ is connected to the power control circuit 135.

The power control circuit 135 determines an intensity of the driving current $I_{sm}$ applied to each of the plurality of amplifiers 134.

The PWRC control circuit 135 includes a plurality of current sources $I_1, \ldots, I_7, I_8$, a plurality of switches SW1, . . . , SW7, SW8, and a first mirror transistor MT1 and a second mirror transistor MT2 which configure a current mirror circuit.

Each of the plurality of switches SW1, . . . , SW7, SW8 and each of the plurality of current sources $I_1, \ldots, I_7, I_8$ are connected in series. Further, the plurality of switches SW1, . . . , SW7, SW8 and the plurality of current sources $I_1, \ldots, I_7, I_8$ which are connected in series are connected in parallel. Further, the plurality of switches SW1, . . . , SW7, SW8 and the plurality of current sources $I_1, \ldots, I_7, I_8$ which are connected in parallel are connected to the current mirror circuit in series. Accordingly, a magnitude of a driving current $I_{sm}$ which is output to the current mirror circuit is determined depending on the on-state of the plurality of switches SW1, . . . , SW7, SW8.

The first mirror transistor MT1 and the second mirror transistor MT2 configure the current mirror circuit.

A gate electrode and a source electrode of the first mirror transistor MT1 are connected to the plurality of switches SW1, . . . , SW7, SW8 to be applied with the driving current $I_{SUM}$.

Further, a gate electrode of the second mirror transistor MT2 is connected to the gate electrode of the first mirror transistor MT1 and a drain electrode of the second mirror transistor MT2 is connected to the terminal $V_{EE}$ of the amplifier 134.

Accordingly, a source-drain current of the second mirror transistor MT2 is determined as the driving current $I_{SUM}$ Further, the driving current $I_{SUM}$ output by the second mirror transistor MT2 is output to the terminal $V_{EE}$ of the amplifier 134.

Accordingly, the power control circuit 135 controls an amplification ratio of each of the plurality of amplifiers 134 to control the power consumption of each of the plurality of amplifiers 134.

Figure 9:
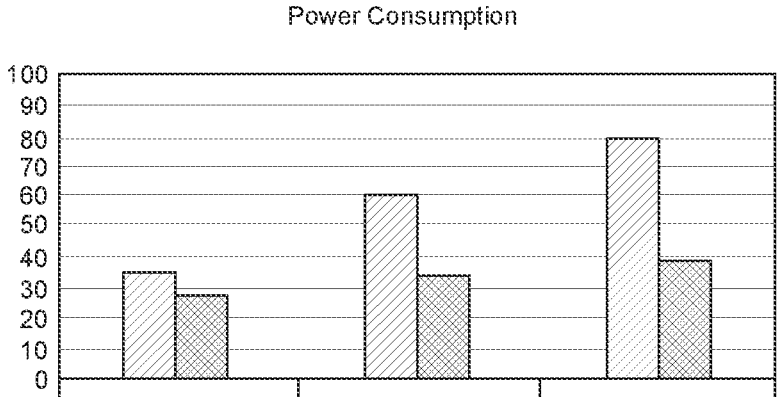
FIG. 9 is a graph illustrating power consumption of a display device according to an exemplary embodiment of the present disclosure.

FIG. 9 is a graph illustrating power consumption of a display device according to an exemplary embodiment of the present disclosure.

Particularly, FIG. 9 illustrates power consumption of each of the images Image I, Image II, and Image III in Comparative Example and Embodiment Example.

According to the comparative example, the power control signal is not supplied for every sub pixel, but one power control signal is applied to one source driving integrated circuit to be driven. Further, according to the embodiment example, as described in the exemplary embodiment of the present disclosure, the power control signal is supplied for a plurality of data lines connected to the sub pixel having the same color.

Further, the first image Image I refers to an image in which one color is dominantly implemented, the second image Image II refers to an image in which a minority of dynamic images is simply implemented, and the third image Image III refers to an image in which a larger number of dynamic images is simply implemented.

For example, a data transition of the second image Image II is larger than a data transition of the first image Image I and a data transition of the third image Image III is larger than the data transition of the second image Image II.

Therefore, as illustrated in FIG. 9, a power consumption of the second image Image II is higher than a power consumption of the first image Image I and a power consumption of the third image Image III is higher than the power consumption of the second image Image II.

However, the power control signal is supplied for every color so that the power consumption of the embodiment example can be reduced more than the power consumption of the comparative example.

Therefore, as illustrated in FIG. 9, a reduced power consumption of the second image Image II is higher than a reduced power consumption of the first image Image I and a reduced power consumption of the third image Image III is higher than the reduced power consumption of the second image Image II.

For example, the display device according to the present disclosure supplies a power control signal for every color to drive the source driving integrated circuit so that the power consumption can be effectively reduced in an image with a high data transition.

Accordingly, the display device according to the exemplary embodiment of the present disclosure reduces the power consumption so that the lifespan is also increased according to the reduced heat generation.

Hereinafter, a display device according to another exemplary embodiment of the present disclosure will be described in detail. The only difference between the display device according to another exemplary embodiment of the present disclosure and the display device according to the exemplary embodiment of the present disclosure is a configuration and an operation of the timing controller and the data driver so that the difference will be mainly described.

Figure 10:
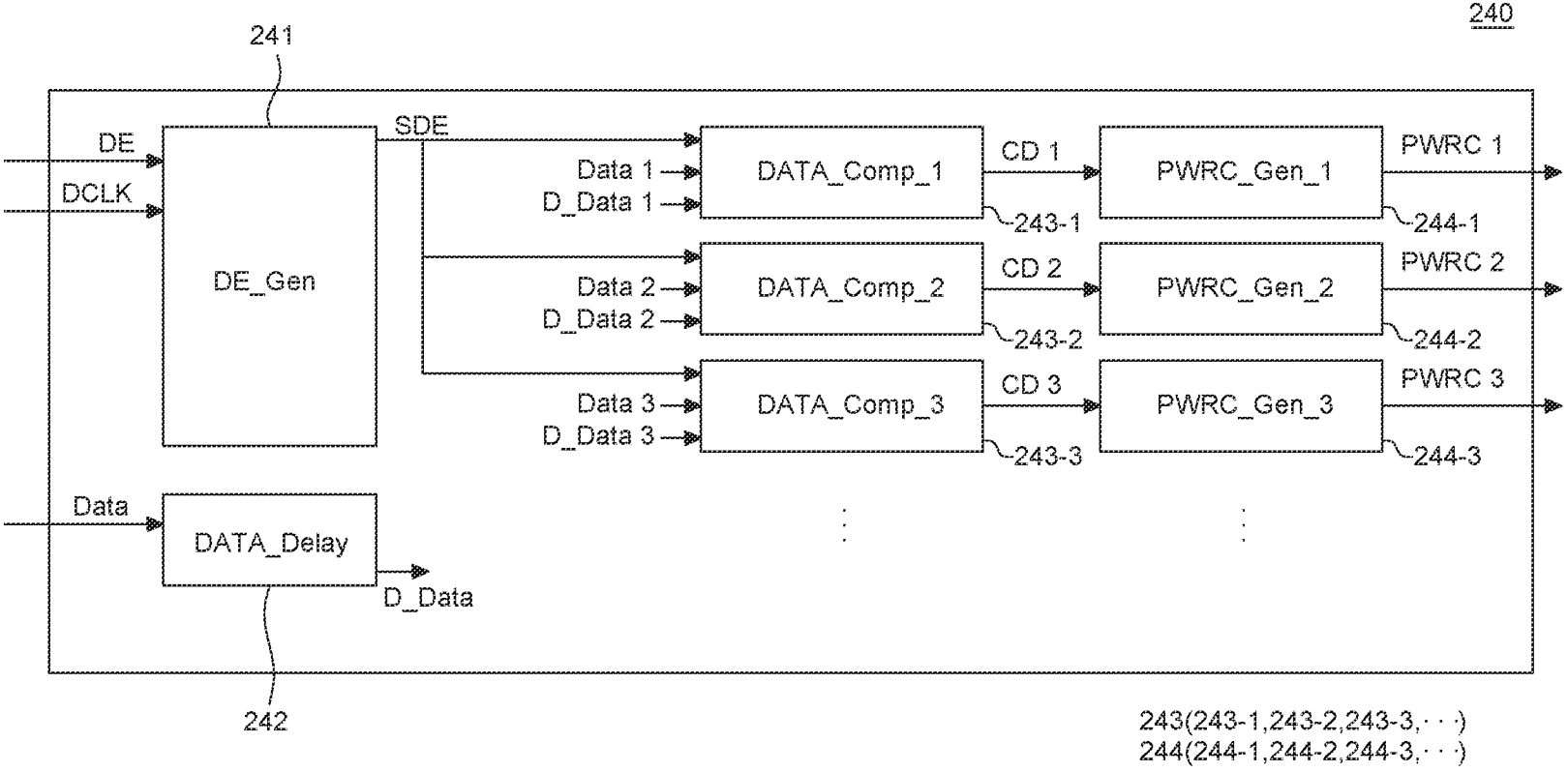
FIG. 10 is a view for explaining a timing controller of a display device according to an exemplary embodiment of the present disclosure.

FIG. 10 is a view for explaining a timing controller of a display device according to an exemplary embodiment of the present disclosure.

Referring to FIG. 10, the timing controller 240 includes a data enable signal generator 241 (GE Gen), a data delaying unit 242 (DATA Delay), a plurality of data comparators 243 (DATA Comp 1, DATA Comp 2 and DATA Comp 3), and a plurality of power control signal generators 244 (PWRC Gen 1, PWRC Gen 2 and PWRC Gen 3).

The data enable signal generator 241 is synchronized with a data enable signal DE and a data clock signal DCLK to output a sub data enable signal SDE to each of the plurality of data comparators 243.

Specifically, the sub data enable signal SDE is a signal which determines a timing that each of the first source driving integrated circuit SDIC #1 to the m-th source driving integrated circuit SDIC #m outputs a data voltage to the active area AA.

For example, since a data voltage is applied to one pixel row during one horizontal period, the sub data enable signal SDE can be output at a high level which is a turn-on level, during one horizontal period.

The data delaying unit 242 is applied with a video data Data to delay the video data by one horizontal period and then output the delayed video data.

The data delaying unit 242 stores the video data Data in an internal memory and delays the video data by one horizontal period, and then outputs the delayed video data D_Data to each of the plurality of data comparators 243.

For example, the data delaying unit 242 stores video data Data corresponding to a n−1-th row in an n−1-th horizontal period and then outputs delayed video data D_Data corresponding to the n−1-th row in a n-th horizontal period.

Figure 11:
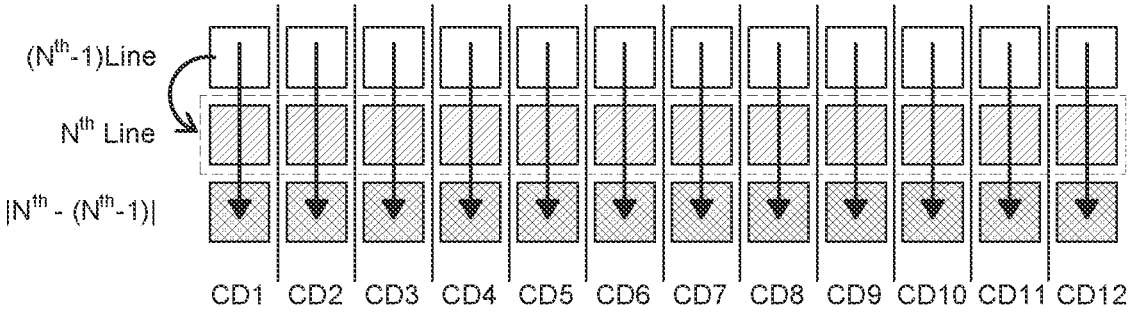
FIG. 11 is a view explaining an operation of a data comparator of a display device according to another exemplary embodiment of the present disclosure.

FIG. 11 is a view explaining an operation of a data comparator of a display device according to an exemplary embodiment of the present disclosure.

Further, each of the plurality of data comparators 243 compares the video data Data and the delayed video data D_Data while the plurality of sub data enable signals SDE is at a turn-on level to generate a plurality of comparison data CD. Further, each of the plurality of data comparators 243 outputs the comparison data CD to the power control signal generator 244. In other words, the above-described comparison data CD can refer to a maximum data transition value of adjacent pixel rows (N−1-th line and N-th line) in each of the plurality of active areas AA.

To be more specific, referring to FIG. 11, the first data comparator 243-1 compares the video data Data of the present pixel row (N-th line) and delayed video data D_Data of the previous pixel row ((N−1)-th line) based on the first data line while the sub data enable signal SDE is at a turn-on level to output first comparison data CD1 to the first power control signal generator 244-1.

The second data comparator 243-2 compares the video data Data of the present pixel row (N-th line) and delayed video data D_Data of the previous pixel row ((N−1)-th line) based on the second data line while the sub data enable signal SDE is at a turn-on level to output second comparison data CD2 to the second power control signal generator 244-2.

The third data comparator 243-3 compares the video data Data of the present pixel row (N-th line) and delayed video data D_Data of the previous pixel row ((N−1)-th line) based on the third data line while the sub data enable signal SDE is at a turn-on level to output third comparison data CD3 to the third power control signal generator 244-3.

The power control signal generator 244 generates a power control signal PWRC using a plurality of comparison data CD.

Specifically, each power control signal generator 244 applies the applied comparison data CD to the look-up table LUT to set the power control signal PWRC.

Referring to FIGS. 10 and 4, the first power control signal generator 244-1 compares the first comparison data CD1 with a plurality of thresholds stored in the LUT to generate a first power control signal PWRC1. Further, the second power control signal generator 244-2 compares the second comparison data CD2 with a plurality of thresholds stored in the LUT to generate a second power control signal PWRC2. Further, the third power control signal generator 244-3 compares the third comparison data CD3 with a plurality of thresholds stored in the LUT to generate a third power control signal PWRC3.

For example, when the comparison data CD is equal to or lower than a first threshold value Th1, the power control signal PWRC is set to P0 (LLL) and when the comparison data CD exceeds the first threshold value Th1 and is equal to or lower than a second threshold value Th2, the power control signal PWRC is set to P1 (LLH). When the comparison data CD exceeds the second threshold value Th2 and is equal to or lower than a third threshold value Th3, the power control signal PWRC is set to P2 (LHL) and when the comparison data CD exceeds the third threshold value Th3 and is equal to or lower than a fourth threshold value Th4, the power control signal PWRC is set to P3 (LHH). When the comparison data CD exceeds the fourth threshold value Th4 and is equal to or lower than a fifth threshold value Th5, the power control signal PWRC is set to P4 (HLL) and when the comparison data CD exceeds the fifth threshold value Th5 and is equal to or lower than a sixth threshold value Th6, the power control signal PWRC is set to P5 (HLH). When the comparison data CD exceeds the sixth threshold value Th6 and is equal to or lower than a seventh threshold value Th7, the power control signal PWRC is set to P6 (HHL) and when the comparison data CD exceeds the seventh threshold value Th7, the power control signal PWRC is set to P7 (HHH).

The first threshold Th1 to seventh threshold Th7 are stored in a memory of the power control signal generator 244 and can vary depending on the setting.

Figure 12:
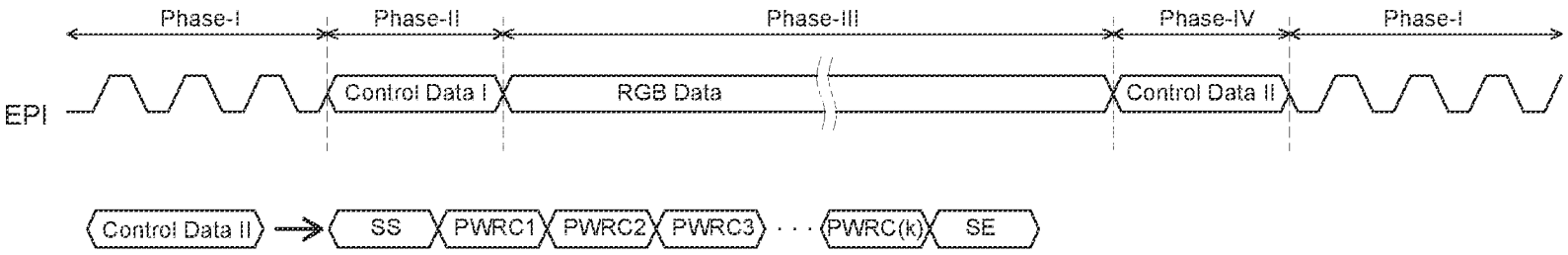
FIG. 12 is a view for explaining a data packet for EPI interface transmission of a timing controller of a display device according to another exemplary embodiment of the present disclosure.

FIG. 12 is a view for explaining a data packet for EPI interface transmission of a timing controller of a display device according to another exemplary embodiment of the present disclosure.

The timing controller 240 is an embedded clock point to point (EPI) interface which transmits/receives data in the form of a voltage of a differential swing level and transmits a data control signal DCS, video data Data, and a power control signal PWRC to the data driver 230.

Specifically, as illustrated in FIG. 12, the data packet for transmission of the EPI interface can be configured by a first phase Phase-I, a second phase Phase-II, a third phase Phase-III, and a fourth phase Phase-IV.

The first phase Phase-I can include a clock signal such as a data clock signal DCLK, the second phase Phase-II can include the data control signal DCS, the third phase Phase-III can include video data Data, and the fourth phase Phase-IV can include the power control signal PWRC.

In the display device according to another exemplary embodiment of the present disclosure, all the plurality of comparison data CD is converted into the power control signal PWRC. Therefore, the data size of the power control signal PWRC is large so that the power control signal PWRC can be included in the fourth phase Phase-IV. For example, the power control signal PWRC can be transmitted to a phase which is transmitted next to the video data Data.

Figure 13:
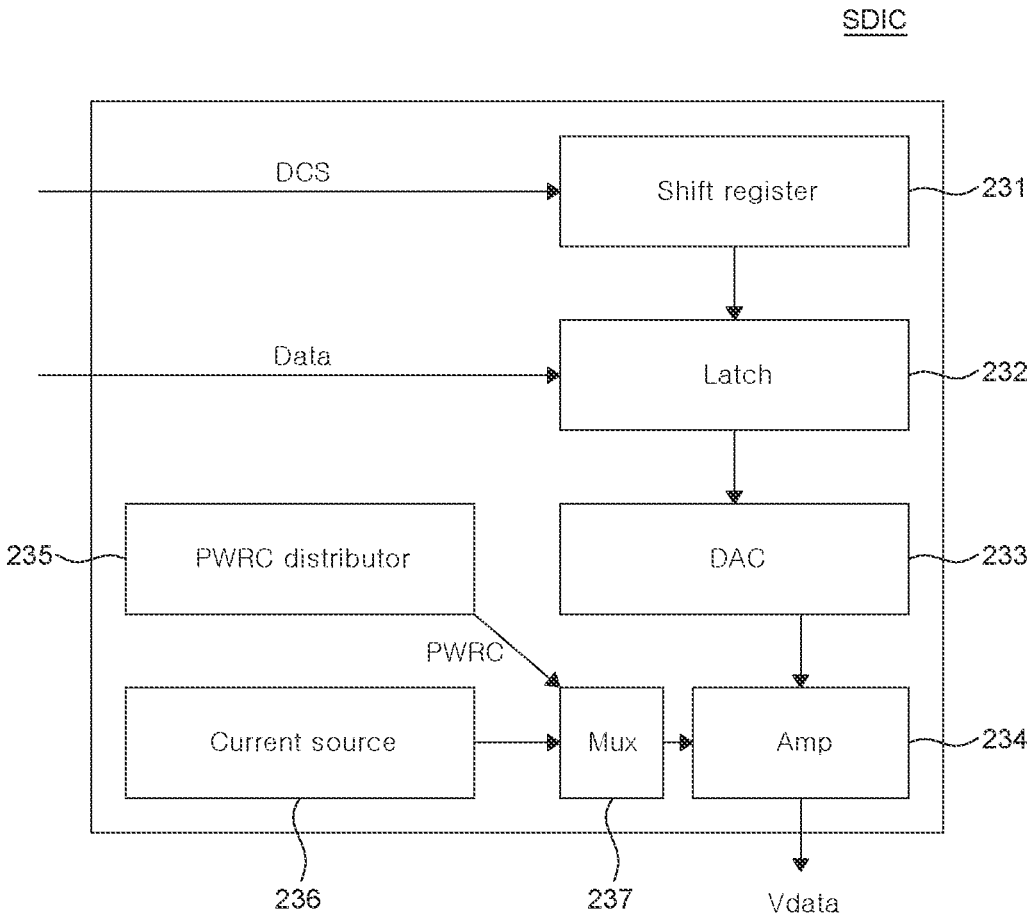
FIG. 13 is a block diagram for schematically explaining a source driving integrated circuit of a display device according to another exemplary embodiment of the present disclosure.

FIG. 13 is a block diagram for schematically explaining a source driving integrated circuit of a display device according to another exemplary embodiment of the present disclosure.

Referring to FIG. 13, each of the plurality of source driving integrated circuits SDIC includes a shift register 231, a latch 232, a digital-analog converter (DAC) 233, an amplifier 234, a power control signal distributor (PWRC distributor) 235, a plurality of driving current sources 236, and a plurality of selectors (MUX) 237.

The shift register 231 receives a data control signal DCS including a source start pulse and a source sampling clock from the timing controller 240 to determine a sequential data sampling timing.

The latch 232 sequentially latches red, green, blue, and white digital video data Data transmitted from the timing controller 240 in response to a sampling signal transmitted from the shift register 231 to simultaneously output the red, green, blue, and white digital video data Data.

The digital-analog converter 233 converts the red, green, blue, and white digital video data Data from the latch 232 into the analog data voltage Vdata using an analog gamma voltage.

The amplifier 234 can output the analog data voltage Vdata transmitted from the digital-analog converter 233 to the data line.

The power control signal distributor 235 outputs the plurality of power control signals PWRC transmitted from the timing controller 240 to each of the plurality of selectors 237.

The plurality of driving current sources 236 can output current having different intensities. The plurality of driving current sources 236 can be constant current sources, but is not limited thereto and can be a current mirror circuit configured to output a plurality of currents. For example, as it will be described in FIG. 15, the plurality of driving current sources 236 can include a total current source HH, a half current source HL, a quarter current source LH, and a zero current source LL.

Each of the plurality of selectors 237 selects one of the plurality of currents applied from the plurality of driving current sources 236 in accordance with the transmitted power control signal PWRC to output the selected current to each of the plurality of amplifiers 234 as a driving current.

Further, each of the plurality of amplifiers 234 is applied with the driving current from each of the plurality of selectors 237 to output the data voltage Vdata to each of the plurality of data lines.

Figure 14:
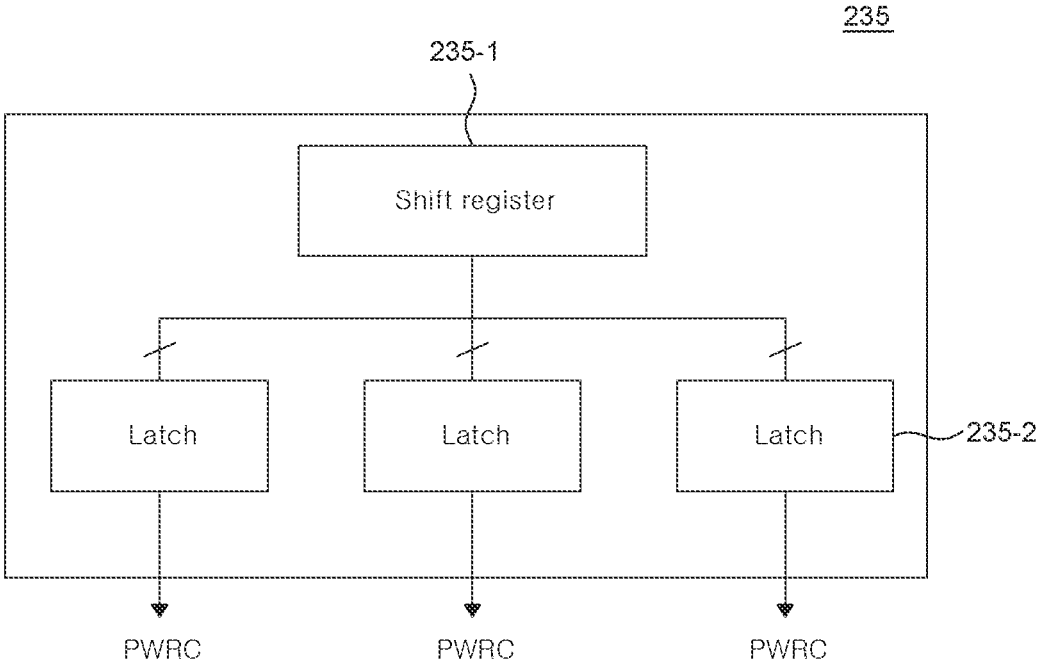
FIG. 14 is a block diagram for explaining a power control signal distributor of a display device according to another exemplary embodiment of the present disclosure.

FIG. 14 is a block diagram for explaining a power control signal distributor of a display device according to another exemplary embodiment of the present disclosure.

As illustrated in FIGS. 13 and 14, the power control signal distributor 235 can include a shift register 235-1 configured to sequentially shift the plurality of power control signals PWRC and a plurality of latches 235-2 configured to align the plurality of shifted power control signals PWRC.

Referring to FIGS. 10 and 14, the shift register 235-1 is applied with the plurality of power control signals PWRC from the plurality of power control signal generators 244 and sequentially shifts the plurality of power control signals to store the plurality of power control signals in the plurality of latches 235-2, respectively.

Referring to FIGS. 13 and 14, each of the plurality of latches 235-2 sequentially latches each of the plurality of power control signals PWRC to simultaneously output the power control signals to the plurality of selectors 237.

Accordingly, the plurality of power control signals PWRC can be simultaneously distributed to the plurality of selectors 237 by the power control signal distributor 235.

Figure 15:
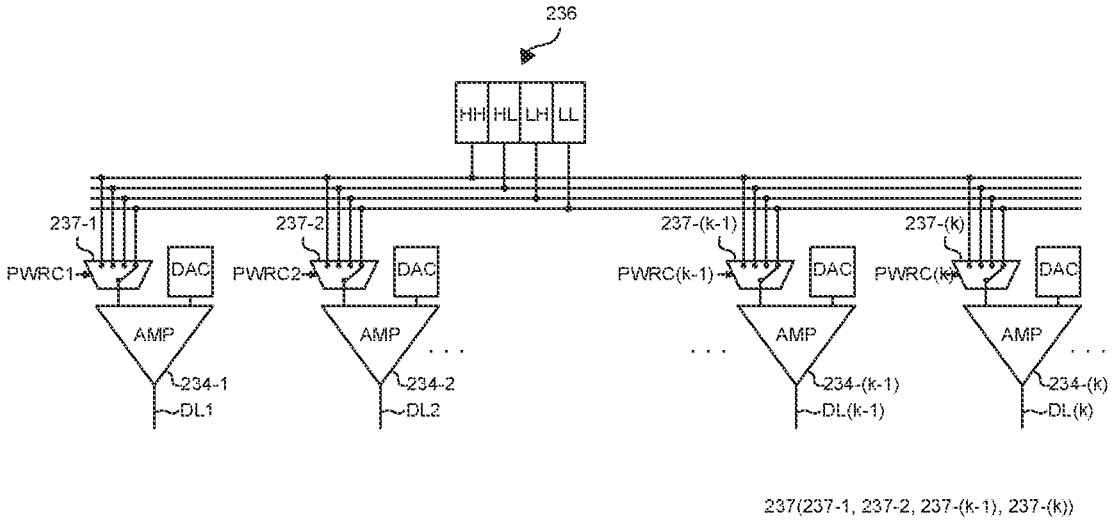
FIG. 15 is a block diagram for explaining a connection relationship of a selector and an amplifier according to another exemplary embodiment of the present disclosure.

FIG. 15 is a block diagram for explaining a connection relationship of a selector and an amplifier according to another exemplary embodiment of the present disclosure.

Referring to FIG. 15, the plurality of amplifiers 234 can include a first amplifier 234-1 connected to a first data line DL1, a second amplifier 234-2 connected to a second data line DL2, . . . , a k−1-th amplifier 234-($k$−1) connected to a k−1-th data line DL(k−1), and a k-th amplifier 234-($k$) connected to a k-th data line DL(k). In this case, k is a natural number of 3 or larger.

Further, the plurality of selectors 237 can include a first selector 237-1 connected to the first amplifier 234-1, a second selector 237-2 connected to the second amplifier 234-2, . . . , a k−1-th selector 237-($k$−1) connected to a k−1-th amplifier 234-($k$−1), and a k-th selector 237-($k$) connected to a k-th amplifier 234-($k$).

Accordingly, the first selector 237-1 selects at least one of currents output from the plurality of driving current sources HH, HL, LH, and LL, in accordance with the first power control signal PWRC1 to output the selected current as a driving current. Further, the first amplifier 234-1 outputs a data voltage to the first data line DL1 using the driving current applied from the first selector 237-1. Further, the second selector 237-2 selects at least one of currents output from the plurality of driving current sources HH, HL, LH, and LL, in accordance with the second power control signal PWRC2 to output the selected current as a driving current. Further, the second amplifier 234-2 outputs a data voltage to the second data line DL2 using the driving current applied from the second selector 237-2. Further, the k−1-th selector 237-(*k*−1) selects at least one of currents output from the plurality of driving current sources HH, HL, LH, and LL, in accordance with the k−1-th power control signal PWRC(k−1) to output the selected current as a driving current. Further, the k−1-th amplifier 234-(*k*−1) outputs a data voltage to the k−1-th data line DL(k−1) using the driving current applied from the k−1-th selector 237-(*k*−1). Further, the k-th selector 237-(*k*) selects at least one of currents output from the plurality of driving current sources HH, HL, LH, and LL, in accordance with the k-th power control signal PWRC(k) to output the selected current as a driving current. Further, the k-th amplifier 234-(*k*) outputs a data voltage to the k-th data line DL(k) using the driving current applied from the k-th selector 237-(*k*).

As described above, the display device according to another exemplary embodiment of the present disclosure can apply different driving currents to each of the plurality of amplifiers 234 via the plurality of selectors 237. For example, the display device according to another exemplary embodiment of the present disclosure individually sets a power control signal in accordance with a transition level of the data voltage applied to the plurality of data lines and individually can set the driving current in accordance with the individually set power control signal.

Accordingly, the driving current of the source driving integrated circuit of the display device according to another exemplary embodiment of the present disclosure is more finely optimized to minimize the power consumption.

As a result, the display device according to another exemplary embodiment of the present disclosure has a lower power consumption to ensure the driving stability by the improved desired lifespan and the minimized heat generation.

The exemplary embodiments of the present disclosure can also be described as follows:

According to an aspect of the present disclosure, a display device includes a display panel including a plurality of sub pixels configured to emit light having different colors, a data driver configured to output a data voltage to the plurality of sub pixels via a plurality of data lines, and a timing controller configured to output a plurality of power control signals for controlling a driving current which drives the data driver. The data driver includes a plurality of source driving integrated circuits connected to the plurality of data lines to output the data voltage to the plurality of data lines. Each of the plurality of source driving integrated circuits includes a plurality of power control circuits configured to generate the driving current in accordance with each of the plurality of power control signals, and a plurality of amplifiers configured to be applied with the driving current to output the data voltage to each of the plurality of data lines. Among the plurality of amplifiers, one or more amplifiers connected to any one of the plurality of first data lines, the plurality of second data lines, the plurality of third data lines, and the plurality of fourth data lines can be connected to any one of the plurality of power control circuits to be applied with the same power control signal.

The plurality of sub pixels can include a plurality of first sub pixel which emits a first color light, a plurality of second sub pixel which emits a second color light, a plurality of third sub pixel which emits a third color light, and a plurality of fourth sub pixel which emits a fourth color light. The plurality of first data lines is connected to the plurality of first sub pixels to be applied with a first data voltage, the plurality of second data lines is connected to the plurality of second sub pixels to be applied with a second data voltage, the plurality of third data lines is connected to the plurality of third sub pixels to be applied with a third data voltage, and the plurality of fourth data lines is connected to the plurality of fourth sub pixels to be applied with a fourth data voltage.

The timing controller can include a data enable signal generator configured to generate a sub data enable signal which determines a timing to output the data voltage to the plurality of sub pixels, a data delaying unit configured to delay a video data by one horizontal period to output delayed video data, a data comparator configured to compare the video data and the delayed video data to generate comparison data, and a power control signal generator configured to generate the power control signal using the comparison data.

The video data can include first video data corresponding to a grayscale level of the first color, second video data corresponding to a grayscale level of the second color, third video data corresponding to a grayscale level of the third color, and fourth video data corresponding to a grayscale level of the fourth color.

The data comparison unit can include a first data comparator configured to compare the first video data and delayed first video data to generate first comparison data, a second data comparator configured to compare the second video data and delayed second video data to generate second comparison data, a third data comparator configured to compare the third video data and delayed third video data to generate third comparison data, and a fourth data comparator configured to compare the fourth video data and delayed fourth video data to generate fourth comparison data.

The power control signal generator can include a first power control signal generator configured to generate a first power control signal using the first comparison data, a second power control signal generator configured to generate a second power control signal using the second comparison data, a third power control signal generator configured to generate a third power control signal using the third comparison data, and a fourth power control signal generator configured to generate a fourth power control signal using the fourth comparison data.

The data comparator can compare the video data and the delayed video data while the sub data enable signal is at a turn-on level to generate a plurality of comparison data.

The timing controller can transmit the video data and the power control signal in the form of an embedded clock point to point interface (EPI) and the power control signal can be transmitted to a previous phase of the video data.

Each of the plurality of source driving integrated circuits can further include a shift register configured to sequentially determine a data sampling timing in accordance with data control signal, a latch configured to sequentially align the digital video data according to the data sampling timing, and a digital-analog converter configured to convert the digital video data into the data voltage using an analog gamma voltage.

The power control circuit can include a first power control circuit configured to supply a driving current in accordance with the first power control signal, a second power control circuit configured to supply a driving current in accordance with the second power control signal, a third power control circuit configured to supply a driving current in accordance with the third power control signal, and a fourth power control circuit configured to supply a driving current in accordance with the fourth power control signal.

The plurality of amplifiers can include a plurality of first amplifiers connected to the plurality of first data lines, a plurality of second amplifiers connected to the plurality of second data lines, a plurality of third amplifiers connected to the plurality of third data lines, and a plurality of fourth amplifiers connected to the plurality of fourth data lines. The plurality of first amplifiers can be connected only to the first power control circuit, the plurality of second amplifiers can be connected only to the second power control circuit, the plurality of third amplifiers can be connected only to the third power control circuit, and the plurality of fourth amplifiers can be connected only to the fourth power control circuit.

The power control circuit can include a plurality of current sources, a plurality of switches connected to the plurality of current sources to control the plurality of current sources, and a current mirror circuit configured to output a driving current determined in accordance with an on-state of the plurality of switches to the amplifiers.

According to another aspect of the present disclosure, a display device includes a display panel which includes a plurality of pixels, a data driver configured to output a data voltage to the plurality of pixels via a plurality of data lines, and a timing controller configured to output a plurality of power control signals for controlling a driving current which drives the data driver. The data driver includes a plurality of source driving integrated circuits connected to the plurality of data lines to output the data voltage to the plurality of data lines. Further, each of the plurality of source driving integrated circuits includes a power control signal distributor configured to output each of the plurality of power control signals to each of a plurality of selectors, a plurality of selectors configured to select one of the plurality of driving currents according to each of the plurality of power control signals, and a plurality of amplifiers configured to be applied with the driving current from each of the plurality of selectors to output the data voltage to each of the plurality of data lines.

The power control signal distributor can include a shift register configured to sequentially shift the plurality of power control signals, and a latch configured to align the plurality of shifted power control signals.

The timing controller can include a data enable signal generator configured to generate a sub data enable signal which determines a timing to output the data voltage to the plurality of pixels, a data delaying unit configured to delay a video data by one horizontal period to output delayed video data, a data comparator configured to compare the video data and the delayed video data to generate comparison data, and a power control signal generator configured to generate the power control signal using the comparison data.

The timing controller can transmit the video data and the power control signal in the form of an embedded clock point to point interface (EPI) and the power control signal can be transmitted to a next phase of the video data.

According to yet another aspect of the present disclosure, a display device comprises a plurality of first sub pixels, a plurality of second sub pixels, and a plurality of third sub pixels, which emit different color lights, a plurality of first data lines connected to the plurality of first sub pixels, a plurality of second data lines connected to the plurality of second sub pixels, a plurality of third data lines connected to the plurality of third sub pixels, a timing controller configured to output a plurality of power control signals for controlling a driving current, a plurality of power control circuits configured to generate the driving current in accordance with each of the plurality of power control signals, and a plurality of amplifiers configured to be applied with the driving current to output data voltage to the plurality of first data lines, the plurality of second data lines, and the plurality of third data lines. Further, among the plurality of amplifiers, one or more amplifiers connected to any one of the plurality of first data lines, the plurality of second data lines, and the plurality of third data lines can be connected to any one of the plurality of power control circuits to be applied with the same power control signal.

The timing controller can include a data comparator configured to compare video data of the corresponding horizontal period and video data of a previous horizontal period to generate comparison data, and a power control signal generator configured to generate the power control signal using the comparison data.

The power control signal generator can include a first power control signal generator configured to generate a first power control signal based on comparison data corresponding to the plurality of first sub pixels, a second power control signal generator configured to generate a second power control signal based on comparison data corresponding to the plurality of second sub pixels, and a third power control signal generator configured to generate a third power control signal based on comparison data corresponding to the plurality of third sub pixels.

The plurality of power control circuits can include a first power control circuit configured to supply a driving current to a plurality of amplifiers connected to the plurality of first data lines based on the first power control signal, a second power control circuit configured to supply a driving current to a plurality of amplifiers connected to the plurality of second data lines based on the second power control signal, and a third power control circuit configured to supply a driving current to a plurality of amplifiers connected to the plurality of third data lines based on the third power control signal.

Although the exemplary embodiments of the present disclosure have been described in detail with reference to the accompanying drawings, the present disclosure is not limited thereto and can be embodied in many different forms without departing from the technical concept of the present disclosure. Therefore, the exemplary embodiments of the present disclosure are provided for illustrative purposes only but not intended to limit the technical concept of the present disclosure. The scope of the technical concept of the present disclosure is not limited thereto.

Therefore, it should be understood that the above-described exemplary embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A display device, comprising:

a display panel including a plurality of sub pixels configured to emit light having different colors;

a data driver configured to output a data voltage to the plurality of sub pixels via a plurality of data lines; and a timing controller configured to output a plurality of power control signals for controlling a driving current which drives the data driver, wherein the plurality of data lines includes a plurality of first data lines, a plurality of second data lines, a plurality of third data lines, and a plurality of fourth data lines, each of the plurality of first data lines, each of the plurality of second data lines, each of the plurality of third data lines, and each of the plurality of fourth data lines are sequentially disposed, the data driver includes a plurality of source driving integrated circuits connected to the plurality of data lines to output the data voltage to each of the plurality of data lines, each of the plurality of source driving integrated circuits includes:

a plurality of power control circuits configured to generate the driving current in accordance with each of the plurality of power control signals; and a plurality of amplifiers configured to be applied with the driving current to output the data voltage to each of the plurality of data lines, and among the plurality of amplifiers, at least one amplifier connected to any one of the plurality of first data lines, the plurality of second data lines, the plurality of third data lines, and the plurality of fourth data lines is connected to a same power control circuit among the plurality of power control circuits to be applied with a same power control signal, wherein the same power control circuit is configured to control an amplification ratio of each of the plurality of amplifiers to control power consumption of each of the plurality of amplifiers, and wherein the timing controller includes:

a data enable signal generator configured to generate a sub data enable signal which determines a timing to output the data voltage to the plurality of sub pixels;

a data delaying unit configured to delay a video data by one horizontal period to output delayed video data;

a data comparator configured to compare the video data and the delayed video data to generate comparison data; and a power control signal generator configured to generate the power control signal using the comparison data.

2. The display device according to claim 1, wherein the plurality of sub pixels includes:

a plurality of first sub pixels configured to emit light of a first color;

a plurality of second sub pixels configured to emit light of a second color;

a plurality of third sub pixels configured to emit light of a third color; and a plurality of fourth sub pixels configured to emit light of a fourth color, the plurality of first data lines is connected to the plurality of first sub pixels to be applied with a first data voltage, the plurality of second data lines is connected to the plurality of second sub pixels to be applied with a second data voltage, the plurality of third data lines is connected to the plurality of third sub pixels to be applied with a third data voltage, and the plurality of fourth data lines is connected to the plurality of fourth sub pixels to be applied with a fourth data voltage.

3. The display device according to claim 2, wherein the video data includes:

first video data corresponding to a grayscale level of the first color;

second video data corresponding to a grayscale level of the second color;

third video data corresponding to a grayscale level of the third color; and fourth video data corresponding to a grayscale level of the fourth color.

4. The display device according to claim 3, wherein the data comparator includes:

a first data comparator configured to compare the first video data and delayed first video data to generate first comparison data;

a second data comparator configured to compare the second video data and delayed second video data to generate second comparison data;

a third data comparator configured to compare the third video data and delayed third video data to generate third comparison data; and a fourth data comparator configured to compare the fourth video data and delayed fourth video data to generate fourth comparison data.

5. The display device according to claim 4, wherein the power control signal generator includes:

a first power control signal generator configured to generate a first power control signal using the first comparison data;

a second power control signal generator configured to generate a second power control signal using the second comparison data;

a third power control signal generator configured to generate a third power control signal using the third comparison data; and a fourth power control signal generator configured to generate a fourth power control signal using the fourth comparison data.

6. The display device according to claim 5, wherein the plurality of power control circuits includes:

a first power control circuit configured to supply a driving current in accordance with the first power control signal;

a second power control circuit configured to supply a driving current in accordance with the second power control signal;

a third power control circuit configured to supply a driving current in accordance with the third power control signal; and a fourth power control circuit configured to supply a driving current in accordance with the fourth power control signal.

7. The display device according to claim 6, wherein the plurality of amplifiers includes a plurality of first amplifiers connected to the plurality of first data lines, a plurality of second amplifiers connected to the plurality of second data lines, a plurality of third amplifiers connected to the plurality of third data lines, and a plurality of fourth amplifiers connected to the plurality of fourth data lines, and the plurality of first amplifiers is connected only to the first power control circuit, the plurality of second amplifiers is connected only to the second power control circuit, the plurality of third amplifiers is connected only to the third power control circuit, and the plurality of fourth amplifiers is connected only to the fourth power control circuit.

8. The display device according to claim 2, wherein the data comparator compares the video data and the delayed video data while the sub data enable signal is at a turn-on level to generate a plurality of comparison data.

9. The display device according to claim 1, wherein the timing controller transmits video data and the power control signal in the form of an embedded clock point to point interface (EPI), and the power control signal is transmitted to a previous phase of the video data.

10. The display device according to claim 1, wherein each of the plurality of source driving integrated circuits further includes:

a shift register configured to sequentially determine a data sampling timing in accordance with a data control signal;

a latch configured to sequentially align digital video data according to the data sampling timing; and a digital-analog converter configured to convert the digital video data into the data voltage using an analog gamma voltage.

11. The display device according to claim 1, wherein each of the plurality of power control circuits includes:

a plurality of current sources;

a plurality of switches connected to the plurality of current sources to control the plurality of current sources; and a current mirror circuit configured to output a driving current determined in accordance with an on-state of the plurality of switches to the amplifiers.

12. A display device, comprising:

a display panel including a plurality of pixels;

a data driver configured to output a data voltage to the plurality of pixels via a plurality of data lines; and a timing controller configured to output a plurality of power control signals for controlling a driving current which drives the data driver, wherein the data driver includes a plurality of source driving integrated circuits connected to the plurality of data lines to output the data voltage to the plurality of data lines, and each of the plurality of source driving integrated circuits includes:

a power control signal distributor configured to output each of the plurality of power control signals to each of a plurality of selectors;

the plurality of selectors configured to select one of a plurality of driving currents according to each of the plurality of power control signals;

a plurality of digital-analog converters configured to convert digital video data into analog data voltage using an analog gamma voltage; and a plurality of amplifiers configured to be applied with a driving current from each of the plurality of selectors to output the data voltage to each of the plurality of data lines, wherein the analog data voltage is transmitted from the plurality of digital-analog converters to each of the plurality of amplifiers, wherein a number of the plurality of digital-analog converters corresponds with a number of the plurality of amplifiers, and wherein the timing controller includes:

a data enable signal generator configured to generate a sub data enable signal which determines a timing to output the data voltage to the plurality of pixels;

a data delaying unit configured to delay a video data by one horizontal period to output delayed video data;

a data comparator configured to compare the video data and the delayed video data to generate comparison data; and a power control signal generator configured to generate the power control signal using the comparison data.

13. The display device according to claim 12, wherein the power control signal distributor includes:

a shift register configured to sequentially shift the plurality of power control signals; and a latch configured to align the plurality of shifted power control signals.

14. The display device according to claim 12, wherein the timing controller is configured to transmit video data and the power control signal in the form of an embedded clock point to point interface (EPI), and the power control signal is transmitted to a next phase of the video data.

15. A display device, comprising:

a plurality of sub pixels comprising a plurality of first sub pixels, a plurality of second sub pixels, and a plurality of third sub pixels, which emit different color lights;

a plurality of first data lines connected to the plurality of first sub pixels;

a plurality of second data lines connected to the plurality of second sub pixels;

a plurality of third data lines connected to the plurality of third sub pixels;

a timing controller configured to output a plurality of power control signals for controlling a driving current;

a plurality of power control circuits configured to generate the driving current in accordance with each of the plurality of power control signals; and a plurality of amplifiers configured to be applied with the driving current to output a data voltage to the plurality of first data lines, the plurality of second data lines, and the plurality of third data lines, wherein among the plurality of amplifiers, at least one amplifier is connected to any one of the plurality of first data lines, and the plurality of second data lines, and the plurality of third data lines is connected to a same power control circuit among the plurality of power control circuits to be applied with a same power control signal, wherein the same power control circuit is configured to control an amplification ratio of each of the plurality of amplifiers to control power consumption of each of the plurality of amplifiers, and wherein the timing controller includes:

a data enable signal generator configured to generate a sub data enable signal which determines a timing to output the data voltage to the plurality of sub pixels;

a data delaying unit configured to delay a video data by one horizontal period to output delayed video data;

a data comparator configured to compare the video data and the delayed video data to generate comparison data; and a power control signal generator configured to generate the power control signal using the comparison data.

16. The display device according to claim 15, wherein the power control signal generator includes:

a first power control signal generator configured to generate a first power control signal based on comparison data corresponding to the plurality of first sub pixels;

a second power control signal generator configured to generate a second power control signal based on comparison data corresponding to the plurality of second sub pixels; and a third power control signal generator configured to generate a third power control signal based on comparison data corresponding to the plurality of third sub pixels.

17. The display device according to claim 16, wherein the plurality of power control circuits includes:

a first power control circuit configured to supply a driving current to the plurality of amplifiers connected to the plurality of first data lines based on the first power control signal;

a second power control circuit configured to supply a driving current to the plurality of amplifiers connected to the plurality of second data lines based on the second power control signal; and a third power control circuit configured to supply a driving current to the plurality of amplifiers connected to the plurality of third data lines based on the third power control signal.

* * * * *